US011352848B2

(12) United States Patent
Scruggs et al.

(10) Patent No.: US 11,352,848 B2
(45) Date of Patent: Jun. 7, 2022

(54) APPARATUS AND METHOD FOR SEPARATING A FLUID CONVEYANCE

(71) Applicant: Axio Energy Services LLC, Weimar, TX (US)

(72) Inventors: Justin Robert Scruggs, Houston, TX (US); John Paul Prichard Jones, Lagrange, TX (US); Bill Wayne Bouziden, Lockhart, TX (US)

(73) Assignee: Axio Energy Services LLC, Houston, TX (US)

( * ) Notice: Subject to any disclaimer, the term of this patent is extended or adjusted under 35 U.S.C. 154(b) by 0 days.

(21) Appl. No.: 17/154,645

(22) Filed: Jan. 21, 2021

(65) Prior Publication Data

US 2021/0238940 A1 Aug. 5, 2021

Related U.S. Application Data

(60) Provisional application No. 62/969,431, filed on Feb. 3, 2020.

(51) Int. Cl.

| | |
|---|---|
| ***E21B 23/04*** | (2006.01) |
| ***E21B 29/02*** | (2006.01) |
| ***E21B 23/01*** | (2006.01) |

(52) U.S. Cl.

CPC ..... *E21B 23/0412* (2020.05); *E21B 23/01* (2013.01); *E21B 23/042* (2020.05); *E21B 29/02* (2013.01)

(58) Field of Classification Search

CPC .... E21B 29/02; E21B 23/0412; E21B 23/042; E21B 23/01

See application file for complete search history.

(56) References Cited

U.S. PATENT DOCUMENTS

| | | | | |
|---|---|---|---|---|
| 4,598,769 | A * | 7/1986 | Robertson | E21B 29/02 166/297 |
| 4,799,829 | A * | 1/1989 | Kenny | E21B 29/02 405/195.1 |
| 5,509,480 | A * | 4/1996 | Terrell | E21B 29/02 102/275.11 |
| 8,056,638 | B2 * | 11/2011 | Clayton | E21B 29/02 166/376 |
| 9,169,705 | B2 * | 10/2015 | Helms | E21B 33/127 |
| 11,203,908 | B2 * | 12/2021 | Al Hussin | E21B 23/00 |
| 2003/0070812 | A1 * | 4/2003 | Robertson | E21B 29/02 166/298 |
| 2009/0301723 | A1 * | 12/2009 | Gray | G01V 11/002 166/301 |
| 2010/0170675 | A1 * | 7/2010 | Daigle | E21B 29/04 166/298 |
| 2019/0078406 | A1 * | 3/2019 | Scruggs | E21B 23/01 |

* cited by examiner

*Primary Examiner* — Shane Bomar
(74) *Attorney, Agent, or Firm* — Ewing & Jones

(57) ABSTRACT

A method and apparatus provide for separating a fluid conveyance, such as coiled tubing, wherein the apparatus includes an anchor section and a carrier that, when united, create an explosive force, separating the fluid conveyance.

16 Claims, 4 Drawing Sheets

APPARATUS AND METHOD FOR SEPARATING A FLUID CONVEYANCE

CROSS-REFERENCE TO RELATED APPLICATIONS

The current application claims priority to U.S. Provisional Patent Application 62/969,431, filed Feb. 3, 2020, the entirety of which is incorporated by reference.

FIELD OF THE DISCLOSURE

Aspects of the disclosure relate to recovery of hydrocarbons from strata. More specifically, aspects of the disclosure relate to a method and apparatus to alter a fluid conveyance that may be used in hydrocarbon recovery operations. The hydrocarbon recovery efforts may take place on land, at sea or a combination of both.

BACKGROUND

Fluid conveyances, such as piping, have many different applications. For example, fluid conveyances are used in many types of drilling. Fluid conveyances can be tubulars, large bore casing, drill strings, coiled tubing or other configurations. Coiled tubing is used on hydrocarbon reserves that are accessible, in some instances at shallow depths, where use of a large scale derrick is impractical or uneconomical. In certain embodiments, coiled tubing may be used in a variety of manners to aid in recovery of hydrocarbons from geological stratum.

As can be understood, drilling a wellbore can be difficult, as many problems can be encountered. A series of valves may be provided to allow for operational variability of the well once drilled. These valves, known as a tree, provide various safety checks so well contents will not escape and become a liability.

At times, there may be a need to sever a fluid conveyance in order to ensure worker safety and prevent wellbore products from escaping. Conventional methods for shearing/severing fluid conveyances are complicated, whereby a ball valve is used to both shut off flow and sever the conveyance.

Such conventional methods have limited applicability in larger size coiled tubing. Also, use of ball valves to perform cutting operations can result in a jagged edge, thereby limiting any attempts to reconnect to the tree as the sealing surfaces can be scarred.

Conventional methods and apparatus to perform such disconnects, however, have significant drawbacks. First, a clean separation is not achieved by such conventional apparatus. Second, there is little "fine tuning" on where the explosive disruptive force is delivered. Conventional methods also merely provide for manually severing pipes whether the location is on land or an offshore platform. This may prove dangerous to personnel because when the tension on the coil is released, the coil can flail uncontrollably at this surface. Such actions can injure individuals and can prove fatal. Conventional methods are also undesirable as the methods force the coiled tubing company to scrap the amount of coil that was left in the well. In many cases, the remaining reel of coil may be useless, as it may be not be long enough to reach a bottom of a well depth.

There is a need to provide a coiled tubing cutter that can separate sections of coiled tubing from one another without damaging large sections of coiled tubing.

There is a further need to provide a coiled tubing cutter that is highly positionable in an underground setting, whether the underground environment is land or sea based.

There is a need to provide apparatus and methods that are easier to operate than conventional apparatus and methods.

There is a still further need to reduce economic costs associated with operations and apparatus of conventional apparatus described above with conventional tools.

There is a further need to sever a conveyance at a depth far below a wellhead, wherein the operator will be able to retrieve a majority of the conveyance, thereby mitigating the amount of the conveyance loss in the well.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method of cutting a fluid conveyance is disclosed. The method may comprise assembling a pressure sensitive device into an anchor. The method may further comprise inserting the anchor into the fluid conveyance. The method may also comprise conveying the anchor to a depth. The method may also comprise activating a pressure sensitive device at the depth. The method may also comprise pressurizing a first chamber within the anchor, wherein a fluid within the first chamber will begin metering to a second chamber. The method may also comprise after metering of the fluid from the first chamber to the second chamber, passing a piston under preset dogs, allowing the dogs to retract, and setting slips to anchor the anchor. The method may also comprise opening bypass portions in the anchor allowing fluid flow circulation past the element. The method may also comprise confirming setting of the anchor in the fluid conveyance. The method may also comprise inserting a carrier into the fluid conveyance. The method may further comprise conveying the carrier downhole until the carrier impacts the anchor. The method may also comprise shifting a dog cover on the carrier. The method may also comprise uncovering a set of firing pin retention dogs in the carrier. The method may also comprise driving a firing pin into a percussion initiator and setting off a charge within the carrier, severing the fluid conveyance.

In another example embodiment, an apparatus for separating a fluid conveyance is disclosed. The apparatus comprises an anchor having a body, a first end, and a second end. The anchor further comprises a pressure sensitive device placed within the body of the anchor, the pressure sensitive device exposed to a fluid pressure outside the anchor, the pressure sensitive device configured to activate at a predetermined pressure, and a plunger configured to move from a first position to a second position, the plunger exposed to the fluid pressure outside the anchor when the pressure sensitive device activates. The apparatus further comprises an orifice positioned within the body, and a first chamber containing a fluid connected to the plunger, wherein upon movement of the plunger from the first position to the second position, the fluid meters through the orifice. The apparatus further comprises a set of slips configured to engage the fluid conveyance when the fluid has metered through the orifice, and a carrier having a carrier first end and a carrier second end, the carrier separate from the anchor. The carrier may comprise a firing pin configured to be activated when the carrier and the anchor connect and a percussion initiator configured to be struck by the firing pin. The carrier may also comprise a booster configured to be activated by the percussion initiator, and an explosive charge configured to be activated by the directional booster is disclosed.

In another example embodiment, an apparatus used in a fluid conveyance is disclosed. The apparatus may comprise an anchor having a body, a set of ports, a first end and a second end, the body having at least one internal channel to convey a fluid from the second end through at least a portion of the body to the set of ports, and a pressure sensitive device placed within the body of the anchor, the pressure sensitive device exposed to a fluid pressure outside the anchor, the pressure sensitive device configured to activate at a predetermined pressure. The apparatus may further comprise a plunger configured to move from a first position to a second position, the plunger exposed to the fluid pressure outside the anchor when the pressure sensitive device activates to move the plunger from the first position to the second position, and an orifice positioned within the body. The apparatus may further comprise a first chamber containing a fluid connected to the plunger, wherein upon movement of the plunger from the first position to the second position, the fluid meters through the orifice; and a set of slips configured to engage the fluid conveyance when the fluid has metered through the orifice.

In another example embodiment, an apparatus used in a fluid conveyance is disclosed. The apparatus comprises a body having an internal chamber, a set of slips positioned on the body and configured to engage the fluid conveyance at an elevation and at least one of time delay mechanism placed within the body, wherein the at least one time delay mechanism is configured to activate the set of slips.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

Figure 1:
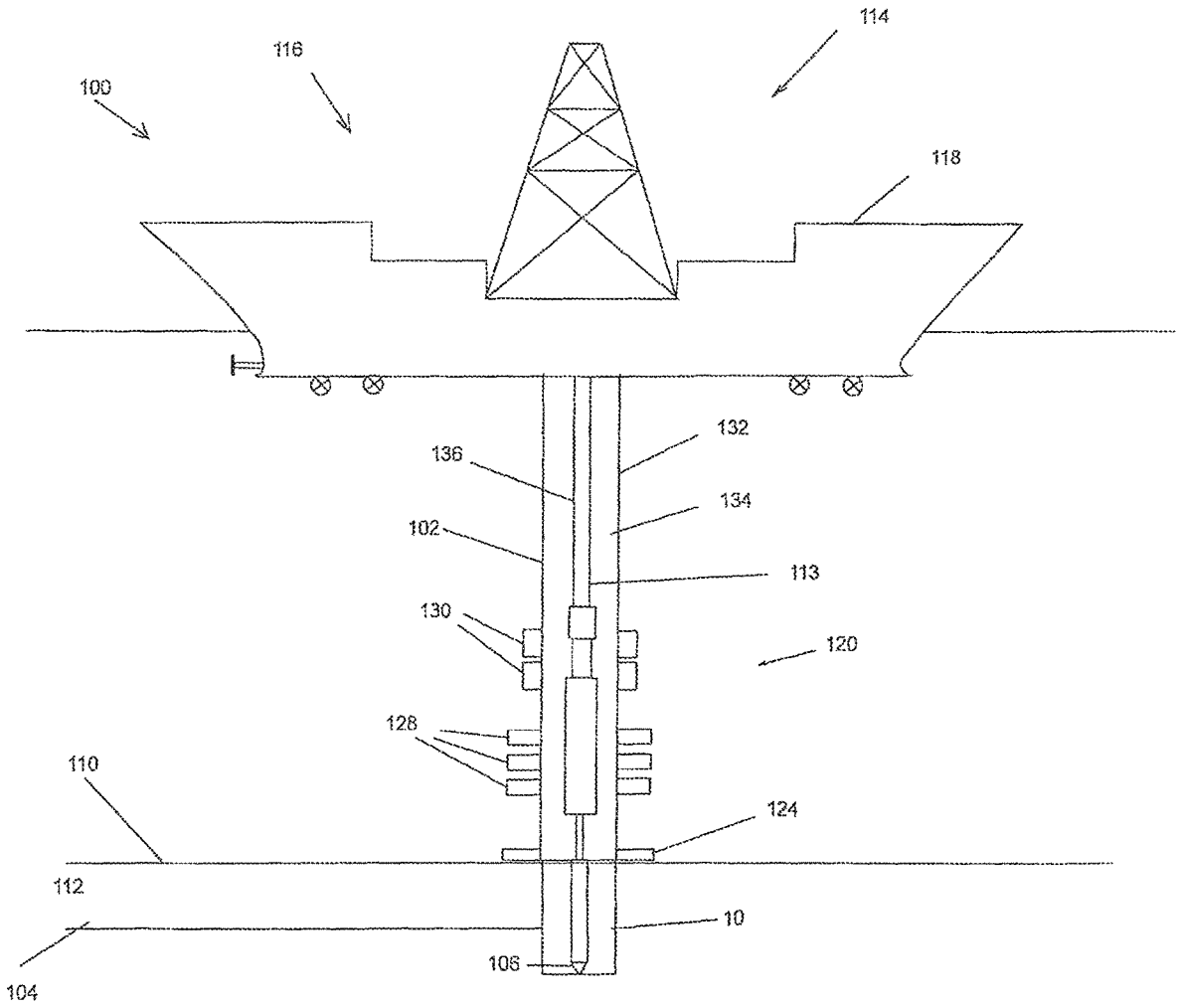
FIG. 1 is a drill ship with extended coiled tubing and valve system used for controlling a wellbore.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and shall not be considered to be an element or limitation of the claims, except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second", and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure provide for a highly positionable fluid conveyance cutter that may be pumped downhole to a specific elevation. The cutter may be provided in one or two separate pieces, namely an anchor section described in FIG. 2, and a carrier described in FIG. 3. In one embodiment, an anchor is inserted into the fluid conveyance and pushed by pumped fluid to a desired elevation or position within a wellbore. A pressure sensitive device within the anchor activates, thereby allowing a fluid contained in a first chamber to be metered into a second chamber within the anchor. With the fluid present within the second chamber, movable slips are activated to expand and to contact the side walls of the fluid conveyance. Once the slips contact the fluid conveyance they prevent movement and are "set". Bypass ports are then opened allowing circulation past the element on the anchor. The anchor is then positioned within the fluid conveyance. Next, a carrier is placed in the fluid conveyance, and fluid pumped downhole conveys the carrier to engage the anchor previously set. After contact between the carrier and the anchor, retaining dogs that contain a firing pin are withdrawn. The firing pin is driven into a separate percussion initiator, which in turn ignites a separate linear shaped charge.

For completeness, the environment in which aspects of the disclosure may be used are described.

Referring to FIG. 1, a drilling ship 100 is illustrated. The purpose of the drilling ship 100 is to recover hydrocarbons located beneath the surface 110 of the ocean floor 112. Different stratum 104 may be encountered during the creation of a wellbore 102. In FIG. 1, a single stratum 104 layer is provided. As will be understood, multiple layers of stratum 104 may be encountered. In embodiments, the stratum 104 may be horizontal layers. In other embodiments, the stratum 104 may be vertically configured. In still further embodiments, the stratum 104 may have both horizontal and vertical layers. Stratum 104 beneath the surface 110 may be varied in composition, and may include sand, clay, silt, rock and/or combinations of these. Operators, therefore, need to assess the composition of the stratum 104 in order to provide maximum penetration of a drill bit 106 that will be used in the drilling process.

The wellbore 102 is formed within the stratum 104 by a drill bit 106. In embodiments, the drill bit 106 is rotated such that contact between the drill bit 106 and the stratum 104 causes portions ("cuttings") of the stratum 104 to be loosened at the bottom of the wellbore 102. Differing types of drill bits 106 may be used to penetrate different types of stratum 104. The types of stratum 104 encountered, therefore, is an important characteristic for operators. The types of drill bits 106 may vary widely. In some embodiments, polycrystalline diamond compact ("PDC") drill bits may be used. In other embodiments, roller cone bits, diamond impregnated or hammer bits may be used. In some embodiments, during the drilling process, vibration may be placed upon the drill bit 106 to aid in the breaking of stratum 104 that are encountered by the drill bit 106. Such vibration may increase the overall rate of penetration ("ROP"), increasing the efficiency of the drilling operations.

In order to prevent hydrocarbons and/or drilling fluids from escaping the wellbore 102, a series of valves in a subsea system 120 is positioned on the ocean floor 112. Different types of valves may be included in the subsea system 120, such as ram preventors 128 and annular preventors 130.

As the wellbore 102 penetrates further into the stratum 104, operators may add portions of drill string pipe 114 to form a drill string 113. As illustrated in FIG. 1, the drill string 113 may extend into the stratum 104 in a vertical orientation. In other embodiments, the drill string 113 and the wellbore 102 may deviate from a vertical orientation. In some embodiments, the wellbore 102 may be drilled in certain sections in a horizontal direction, parallel with the surface 110.

Figure 2:
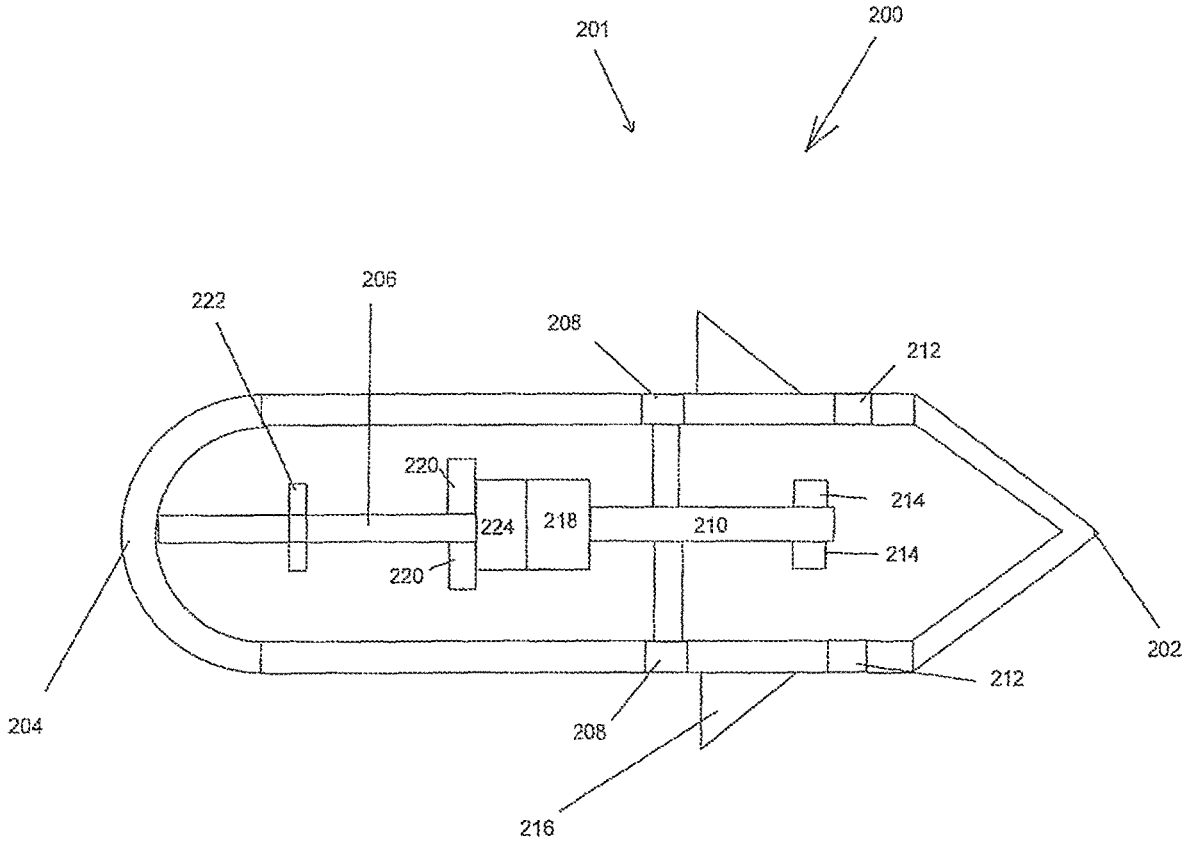
FIG. 2 is a cross-section of an anchor section of a fluid conveyance cutter in accordance with one example embodiment of the disclosure.

Referring to FIG. 2, an anchor 200 is disclosed. The anchor 200 has a body 201 that may be placed in a fluid conveyance, such as coiled tubing, and conveyed downhole to an elevation or depth where the fluid conveyance is required to be cut/severed. The anchor 200 has several components. The anchor 200 has a first end 202 and a second end 204. The first end 202 is shaped in a conical arrangement to allow for less resistance of the anchor 200 moving through fluid, such as water, completion fluid, drilling fluid, frac fluid pumped down the fluid conveyance. The second end 204 is formed as a spherical cap which is configured to mate with a dog cover 301 illustrated in FIG. 3 and described below. Although disclosed as a spherical arrangement, other configurations are possible and the illustrated embodiment should not be considered limiting. As will be understood, the second end 204 that has the cap may be other configurations other than spherical. A pressure sensitive device 222 is positioned within the anchor 200 and is open to pressure within the fluid conveyance as the anchor 200 travels down the fluid conveyance. The pressure sensitive device 222 is configurable, for example, in 500 psi increments, as a non-limiting embodiment. After activation of the pressure sensitive device 222, a plunger 206 moves to pressurize a fluid within the first chamber 218 that is then metered through an orifice 224 to a second chamber 220. The fluid may be, for example, a silicon fluid. Other types of fluids may also be used. The second chamber 220, may be, in a non-limiting embodiment, an atmospheric chamber. Once the fluid has metered through the orifice 224 into the second chamber 220, a delay piston 210 with an outer groove passes under a set of anti-preset dogs 214, allowing the anti-preset dogs 214 to retract. The retraction of the anti-preset dogs 214 allows an expansion of the outer portion of the anchor 200 to the point where slips 212 contact the inside diameter of the fluid conveyance. The anchor 200 is also provided with an element 216 that allows for conveyance of the anchor 200 down the fluid conveyance. Bypass ports 208 are configured to open from a closed position after the anchor 200 is set, allowing fluid to pass through the anchor 200 at a reduced rate, thereby allowing for pumping down of fluid and other components into the fluid conveyance. In a non-limiting example, the bypass ports 208 are ¼" ports that are located every 90 degrees around the surface of the anchor 200. As will be understood, while described as an orifice 224, other configurations are possible, including a jet or a simple opening. In embodiments, the slips 212 may be configured with a surface that enhances friction contact between the slip 212 and the inside surface of the fluid conveyance.

Figure 3:
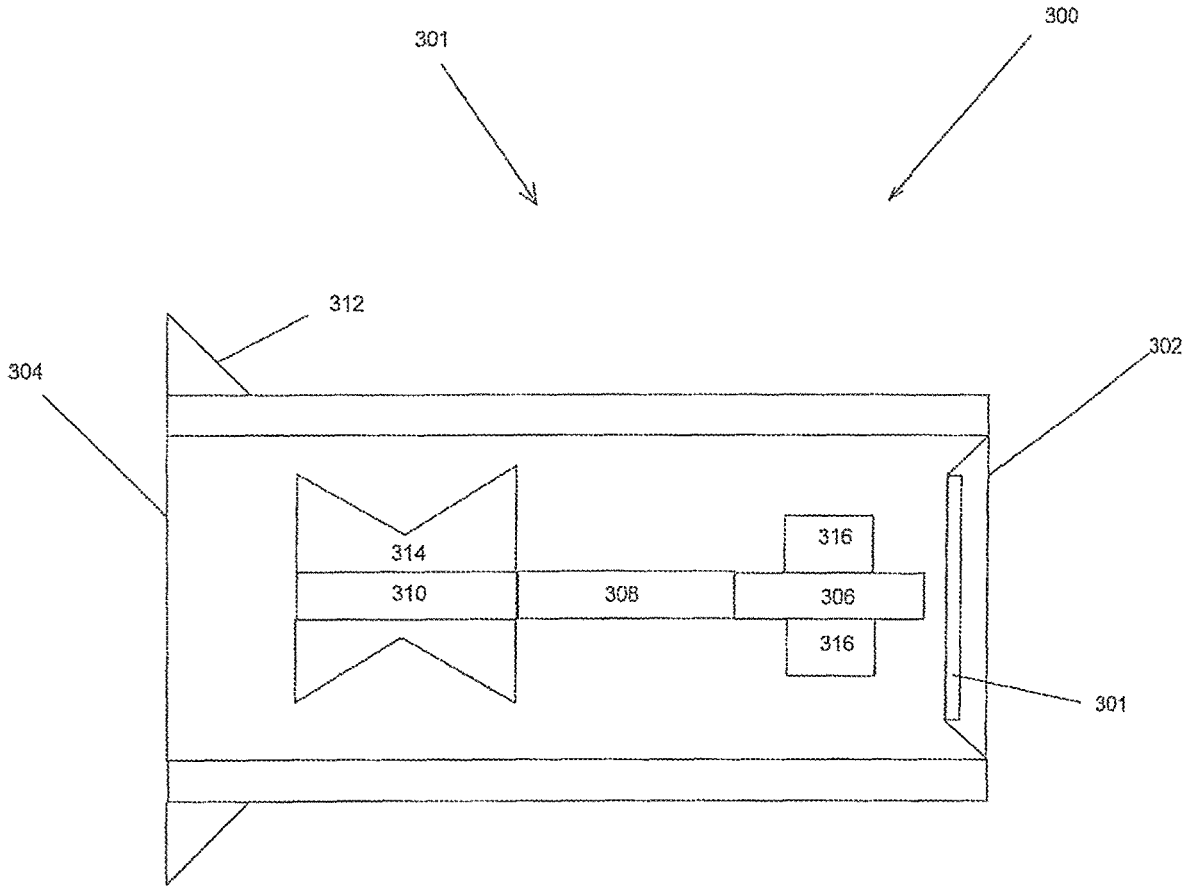
FIG. 3 is a cross-section of a carrier of the fluid conveyance cutter.

Referring to FIG. 3, a carrier 300 is illustrated. The carrier 300 conveys explosive or non-explosive cutting materials downhole to the anchor 200, where the materials are subsequently activated or detonated. The carrier 300 has a first end 302 and a second end 304. The first end 302 has a force activated dog cover 301. The force activated dog cover 301 may be recessed to prevent accidental loading and premature firing of the explosives or cutting materials. The force activated dog cover 301 may be moved through contact between the carrier 300 contacting the anchor 200 when the carrier 300 is conveyed downhole. Conveyance of the carrier 300 occurs through fluid pushing the carrier 300 along an element 312 located in proximity to the second end 304. In a non-limiting embodiment, the element 312 may be a slip-on rubber element, such as a HNBR/Polyurethane member, or a polyurethane material. With embodiments for both the anchor 200 and the carrier 300, elements may be configured as a "slip-on" element or may be integrally attached to the respective body of the anchor 200 and/or carrier 300.

Once contact is established between the anchor 200 and the carrier 300, the force activated dog cover 301 shifts and uncovers firing pin retention dogs 316. The firing pin retention dogs 316 release, thereby sending the firing pin 306 into a percussion initiator 308 housed within the carrier 300. The release of the firing pin 306 occurs through hydrostatic pressure in one example embodiment. In other embodiments, the firing pin 306 may be propelled through action of a spring or other energy holding arrangement, such as an accumulator. In still further embodiments, the firing pin 306 may be propelled through a mechanical force arrangement when the carrier 300 collides with the anchor 200.

After contact between the firing pin 306 and the percussion initiator 308, a release of energy occurs that is transferred to a booster 310 and a charge 314. The charge 314 may be a shaped charge that causes an explosion in a specific direction, thereby separating the fluid conveyance (coiled tubing) that the anchor 200 and the carrier 300 were placed inside. In one non-limiting embodiment, the charge 314 is a shaped charge. The shaped charge 314 may explode in a predetermined pattern, providing a clean separation of the fluid conveyance at a desired point or perforation without separation.

Figure 4:
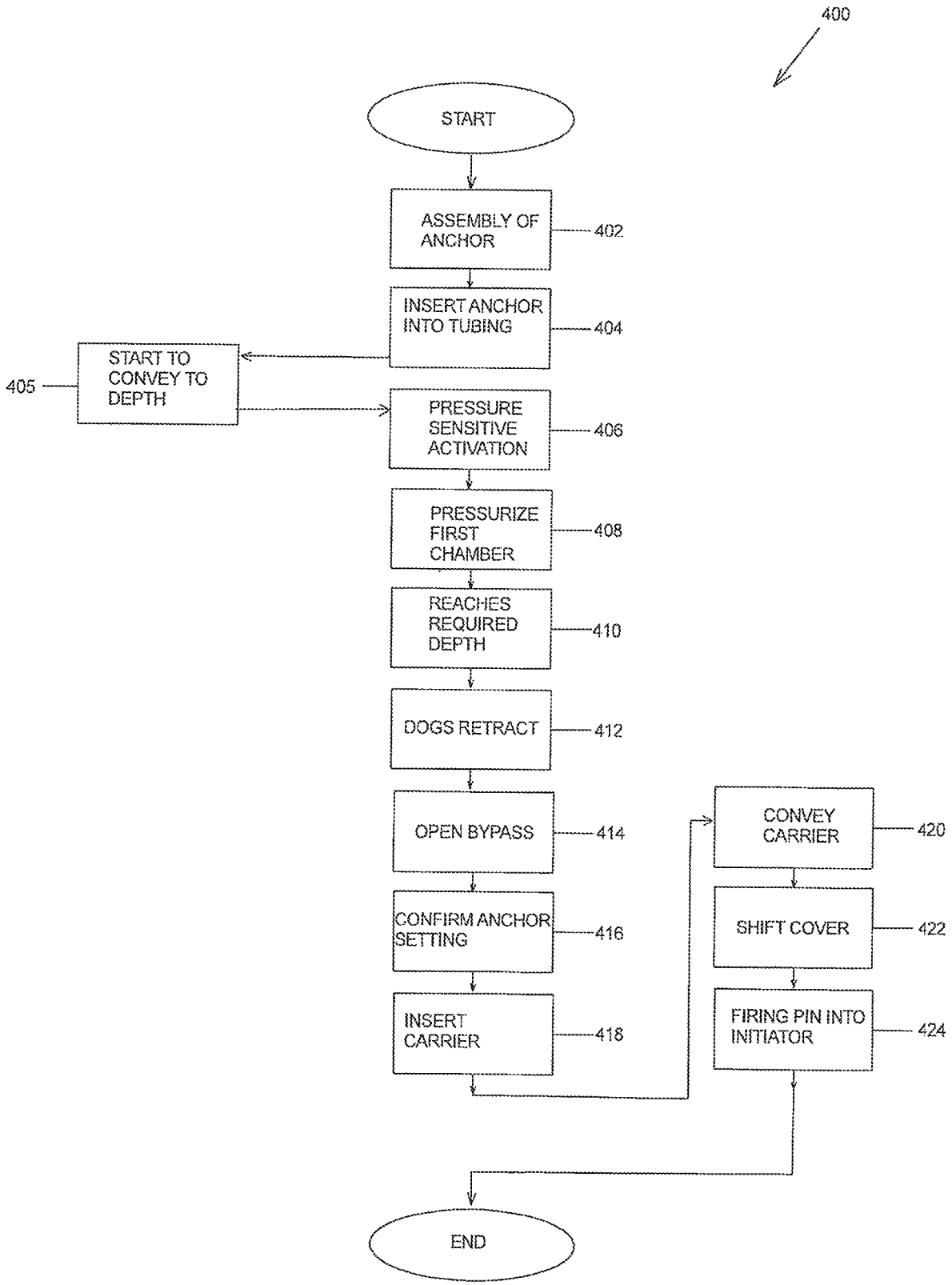
FIG. 4 is a method of cutting a fluid conveyance in accordance with an aspect of the disclosure.

Referring to FIG. 4, a method 400 for operation of a fluid conveyance cutter is illustrated. At 402, an anchor is assembled with a pressure sensitive device. The type of pressure sensitive device that is used in the assembly of the anchor corresponds to the density of the wellbore fluid and the targeted true vertical depth at which the pressure sensitive device is configured to. At 404, the operator inserts the anchor into the fluid conveyance. The insertion may occur, for example, at the reel swivel. At 405, the anchor is started to be pumped downhole. At 406, the pressure sensitive device is activated while the conveyance is being pumped downhole. At 408, a plunger will pressurize a first chamber, wherein a fluid within the chamber will begin metering to a second chamber. The second chamber may be, for example, an atmospheric chamber. The fluid may be a silicone oil, as a non-limiting embodiment. At 410, the anchor reaches the desired depth at which the fluid conveyance is to be cut. At 412, once the fluid has metered to the chamber, an outside diameter groove of a piston passes under preset dogs, allowing the dogs to retract, setting slips to anchor the anchor at the desired depth reached at 410. At 414, bypass portions are opened in the anchor allowing circulation past the element. At 416, after a calculated delay time, the operator may initiate flow to confirm anchor setting. Confirmation of anchor setting may be noted by restricted flow through the bypass ports. After confirmation of anchor setting at 416, at 418 a carrier may be inserted into the fluid conveyance. Similar to that described above, the insertion may occur at the reel swivel. At 420, the carrier may be conveyed downhole until the carrier impacts the set anchor. At 422, after impact of the carrier to the anchor, a dog cover is shifted on the carrier. At 424, a set of firing pin retention dogs are uncovered and a pressure activated firing pin is driven into a percussion initiator by hydrostatic pressure, setting off a charge, severing the fluid conveyance. In other example embodiments, the charge may be used to only penetrate the fluid conveyance and not sever the fluid conveyance. The charge may be a shaped charge, in one example embodiment. As will be understood, different embodiments may be performed, such as conveying the anchor down hole, bursting the pressure sensitive device at a predetermined elevation, and continuing to convey the anchor downhole until a time delay (as dictated by the metering fluid) ends, thereby setting the anchor. In other embodiments, no time delay is present and the anchor may be immediately set. As will also be understood, an electronic device may be used for setting off the charge within the body of either a one piece or two piece anchor and carrier design. In other designs, dissolvable materials may be used to slowly erode over time to provide a time for activation of the charge or the setting of slips or both. In other embodiments, the electronic device or a soluble material may be used to activate a set of slips on the anchor itself.

Although the aspects described above relate to fluid conveyance cutting and intervention tools deployed in coiled tubing, it should be understood that aspects of the disclosure can be used to sever piping in which the cutting apparatus is placed. Aspects of the disclosure avoid manual severing pipe, thereby maintaining safety for personnel. Aspects of the disclosure also provide for severing a pipe downhole, maximizing the amount of coil that can be retrieved from the well, thereby reducing the chances of the remaining reel from having to be scrapped due to it not being long enough to reach the bottom of an average well depth.

In one example embodiment, a method of cutting a fluid conveyance is disclosed. The method may comprise assembling a pressure sensitive device into an anchor. The method may further comprise inserting the anchor into the fluid conveyance. The method may also comprise conveying the anchor to a depth at which the fluid conveyance is to be cut. The method may also comprise activating a pressure sensitive device at a depth. The method may also comprise pressurizing a first chamber within the anchor, wherein a fluid within the first chamber will begin metering to a second chamber. The method may also comprise after metering of the fluid from the first chamber to the second chamber, passing a piston under preset dogs, allowing the dogs to retract, setting slips to anchor the anchor. The method may also comprise opening bypass portions in the anchor allowing fluid flow circulation past the element. The method may also comprise confirming setting of the anchor in the fluid conveyance. The method may also comprise inserting a carrier into the fluid conveyance. The method may further comprise conveying the carrier downhole until the carrier impacts the anchor. The method may also comprise shifting a dog cover on the carrier. The method may also comprise uncovering a set of firing pin retention dogs in the carrier. The method may also comprise driving a firing pin into a percussion initiator and setting off a charge within the carrier, severing the fluid conveyance.

In another example embodiment, the method may be performed wherein the inserting occurs at a reel swivel.

In another example embodiment, the method may be performed wherein the conveying the anchor to the depth is through pumping a fluid down the fluid conveyance conveying the anchor.

In another example embodiment, the method may be performed wherein the second chamber is an atmospheric chamber.

In another example embodiment, the method may be performed wherein the confirming of the setting of the anchor is by identifying a pressure increase from a normally open well condition to an anchor set position.

In another example embodiment, the method may be performed wherein the inserting the carrier occurs at the reel swivel.

In another example embodiment, an apparatus for separating a fluid conveyance is disclosed. The apparatus comprises an anchor having a body, a first end, and a second end. The anchor further comprises a pressure sensitive device placed within the body of the anchor, the pressure sensitive device exposed to a fluid pressure outside the anchor, the pressure sensitive device configured to activate at a predetermined pressure, and a plunger configured to move from a first position to a second position, the plunger exposed to the fluid pressure outside the anchor when the pressure sensitive device activates. The apparatus further comprises an orifice positioned within the body and a first chamber containing a fluid connected to the plunger, wherein upon movement of the plunger from the first position to the second position, the fluid meters through the orifice. The apparatus further comprises a set of slips configured to engage the fluid conveyance when the fluid has metered through the orifice, and a carrier having a carrier first end and a carrier second end, the carrier separate from the anchor. The carrier may comprise a firing pin configured to be activated when the carrier and the anchor connect, and a percussion initiator configured to be struck by the firing pin. The carrier may also comprise a booster configured to be activated by the percussion initiator, and an explosive charge configured to be activated by the directional booster.

In another example embodiment, the carrier may further comprise an element configured to fit around a body of the carrier at the second end.

In another example embodiment, the apparatus may be configured wherein the anchor is configured with an element around the body of the anchor configured to engage the fluid conveyance.

In another example embodiment, the apparatus may be configured wherein the element is made of rubber.

In another example embodiment, the apparatus may be configured wherein the anchor is configured with bypass ports extending from an outside environment of the anchor to an interior of the body of the anchor, wherein the interior of the body has at least one fluid channel.

In another example embodiment, an apparatus used in a fluid conveyance is disclosed. The apparatus may comprise an anchor having a body, a set of ports, a first end and a second end, the body having at least one internal channel to convey a fluid from the second end through at least a portion of the body to the set of ports, and a pressure sensitive device placed within the body of the anchor, the pressure sensitive device exposed to a fluid pressure outside the anchor, the pressure sensitive device configured to activate at a predetermined pressure. The apparatus may further comprise a plunger configured to move from a first position to a second position, the plunger exposed to the fluid pressure outside the anchor when the pressure sensitive device activates to move the plunger from the first position to the second position, and an orifice positioned within the body. The apparatus may further comprise a first chamber containing a fluid connected to the plunger, wherein upon movement of the plunger from the first position to the second position, the fluid meters through the orifice; and a set of slips configured to engage the fluid conveyance when the fluid has metered through the orifice.

In another non-limiting embodiment, the apparatus may further comprise an element configured to interface with an exterior of the body of the anchor.

In another non-limiting embodiment, the apparatus may be configured wherein the slip on element is made of rubber.

In one non-limiting embodiment, the apparatus may further comprise a delay piston configured to move from a first position to a second position and a set of anti-preset dogs configured to interface with the delay piston.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims, or any subsequent claims, shall not be unduly limited by the description of the embodiments described herein.

What is claimed is:

1. A method of cutting a fluid conveyance comprising:
- assembling a pressure sensitive device into an anchor;
- inserting the anchor into the fluid conveyance;
- starting a process of conveying the anchor to a depth at which a coiled tubing is to be cut;
- activating the pressure sensitive device at a depth during the conveying;
- pressurizing a first chamber within the anchor, wherein a fluid within the first chamber will begin metering to a second chamber during the conveying;
- after metering of the fluid from the first chamber to the second chamber, passing a piston under preset dogs allowing the dogs to retract, setting slips to anchor the anchor at the depth;
- opening bypass portions in the anchor allowing fluid flow circulation;
- confirming setting of the anchor in the fluid conveyance;
- inserting a carrier into the fluid conveyance;
- conveying the carrier downhole until a charge carrier impacts the anchor;
- shifting a dog cover on the carrier;
- uncovering a set of firing pin retention dogs in the carrier;
- driving a firing pin into a percussion initiator; and
- setting off a charge within the carrier, one of penetrating and severing the fluid conveyance.

2. The method according to claim 1, wherein one of the inserting anchor into the fluid conveyance and inserting the carrier into the fluid conveyance occurs at a reel swivel.

3. The method according to claim 1, wherein the conveying the anchor to the depth at which the fluid conveyance is to be cut is through pumping a fluid down the fluid conveyance conveying the anchor.

4. The method according to claim 1, wherein the second chamber is an atmospheric chamber.

5. The method according to claim 1, wherein the confirming of the setting of the anchor is by identifying a pressure increase from a normally open unrestricted tubular condition to an anchor set position.

6. The method according to claim 1, wherein the inserting the carrier occurs at a reel swivel.

7. An apparatus for separating a fluid conveyance, comprising:
- an anchor having a body, a first end and a second end, the anchor further comprising;
- a pressure sensitive device placed within the body of the anchor, the pressure sensitive device exposed to a fluid pressure outside the anchor, the pressure sensitive device configured to activate at a predetermined pressure;
- a plunger configured to move from a first position to a second position, the plunger exposed to the fluid pressure outside the anchor when the pressure sensitive device activates;

an orifice positioned within the body;

a first chamber containing a fluid connected to the plunger, wherein upon movement of the plunger from the first position to the second position, the fluid meters through the orifice; and a set of slips configured to engage the fluid conveyance when the fluid has metered through the orifice;

a carrier having a carrier first end and a carrier second end, the carrier separate from the anchor, the carrier comprising:

a firing pin configured to be activated when the carrier and the anchor connect;

a percussion initiator configured to be struck by the firing pin;

a booster configured to activated by the percussion initiator; and an explosive charge configured to be activated by the booster.

8. The apparatus according to claim 7, wherein the carrier further comprises:

an element configured to fit around a body of the carrier at the second end.

9. The apparatus according to claim 7, wherein the anchor is configured with an element around the body of the anchor configured to engage the fluid conveyance.

10. The apparatus according to claim 9, wherein the element is made of one of a rubber and a polyurethane.

11. The apparatus according to claim 8, wherein the element is made of rubber, or a similar material.

12. The apparatus according to claim 7, wherein the anchor is configured with bypass ports extending from an outside environment of the anchor to an interior of the body of the anchor, wherein the interior of the body has at least one fluid channel.

13. An apparatus used in a fluid conveyance, comprising:

an anchor having a body, a set of ports, a first end and a second end, the body having at least one internal channel to convey a fluid from the second end through at least a portion of the body to the set of ports;

a pressure sensitive device placed within the body of the anchor, the pressure sensitive device exposed to a fluid pressure outside the anchor, the pressure sensitive device configured to activate at a predetermined pressure;

a plunger configured to move from a first position to a second position, the plunger exposed to the fluid pressure outside the anchor when the pressure sensitive device activates to move the plunger from the first position to the second position;

an orifice positioned within the body;

a first chamber containing a fluid connected to the plunger, wherein upon movement of the plunger from the first position to the second position, the fluid meters through the orifice; and a set of slips configured to engage the fluid conveyance when the fluid has metered through the orifice.

14. The apparatus according to claim 13, further comprising:

an element configured to interface with an exterior of the body of the anchor.

15. The apparatus according to claim 14, wherein the element is made of one of a rubber and a polyurethane material.

16. The apparatus according to claim 14, further comprising:

a delay piston configured to move from a first position to a second position; and a set of anti-preset dogs configured to interface with the delay piston.

* * * * *